US005639980A

United States Patent [19]

Imaizumi

[11] Patent Number: 5,639,980

[45] Date of Patent: Jun. 17, 1997

[54] PERFORMANCE DATA EDITING APPARATUS

[75] Inventor: Tsutomu Imaizumi, Hamamatsu, Japan

[73] Assignee: Yamaha Corporation, Japan

[21] Appl. No.: 570,434

[22] Filed: Dec. 11, 1995

[30] Foreign Application Priority Data

Dec. 9, 1994 [JP] Japan ..... 6-306083

[51] Int. Cl.[6] ..... G10H 1/38

[52] U.S. Cl. ..... 84/637; 84/669; 84/DIG. 22

[58] Field of Search ..... 84/613, 637, 650–652, 84/669, 715, DIG. 22, 609

[56] References Cited

U.S. PATENT DOCUMENTS

| | | | |
|---|---|---|---|
| 4,953,438 | 9/1990 | Shibukawa | 84/609 |
| 4,981,066 | 1/1991 | Kakizaki | 84/613 |
| 5,085,118 | 2/1992 | Sekizuka | 84/637 X |
| 5,218,153 | 6/1993 | Minamitaka | 84/613 |
| 5,218,157 | 6/1993 | Akagawa et al. | 84/637 |

FOREIGN PATENT DOCUMENTS

| | | |
|---|---|---|
| 58-28790 | 2/1983 | Japan . |
| 59-195281 | 11/1984 | Japan . |
| 5-232938 | 9/1993 | Japan . |
| 6-295179 | 2/1994 | Japan . |
| 6-259074 | 9/1994 | Japan . |

*Primary Examiner*—Stanley J. Witkowski
*Attorney, Agent, or Firm*—Rossi & Associates

[57] ABSTRACT

A performance data editing apparatus wherein chords in performance data of a musical tune applied from an external memory element or performance apparatus are detected and normalized into a predetermined tone scale on a basis of their respective types and roots, the musical tune including a plurality of performance parts at least one of which represents the chords indicative of a musical progression having a performance pattern, and wherein the normalized chords are converted on a basis of chords designated to be performed-for production of a desired accompaniment data, thereby to produce edited chords indicative of a progression of the designated chords in the performance pattern.

8 Claims, 11 Drawing Sheets

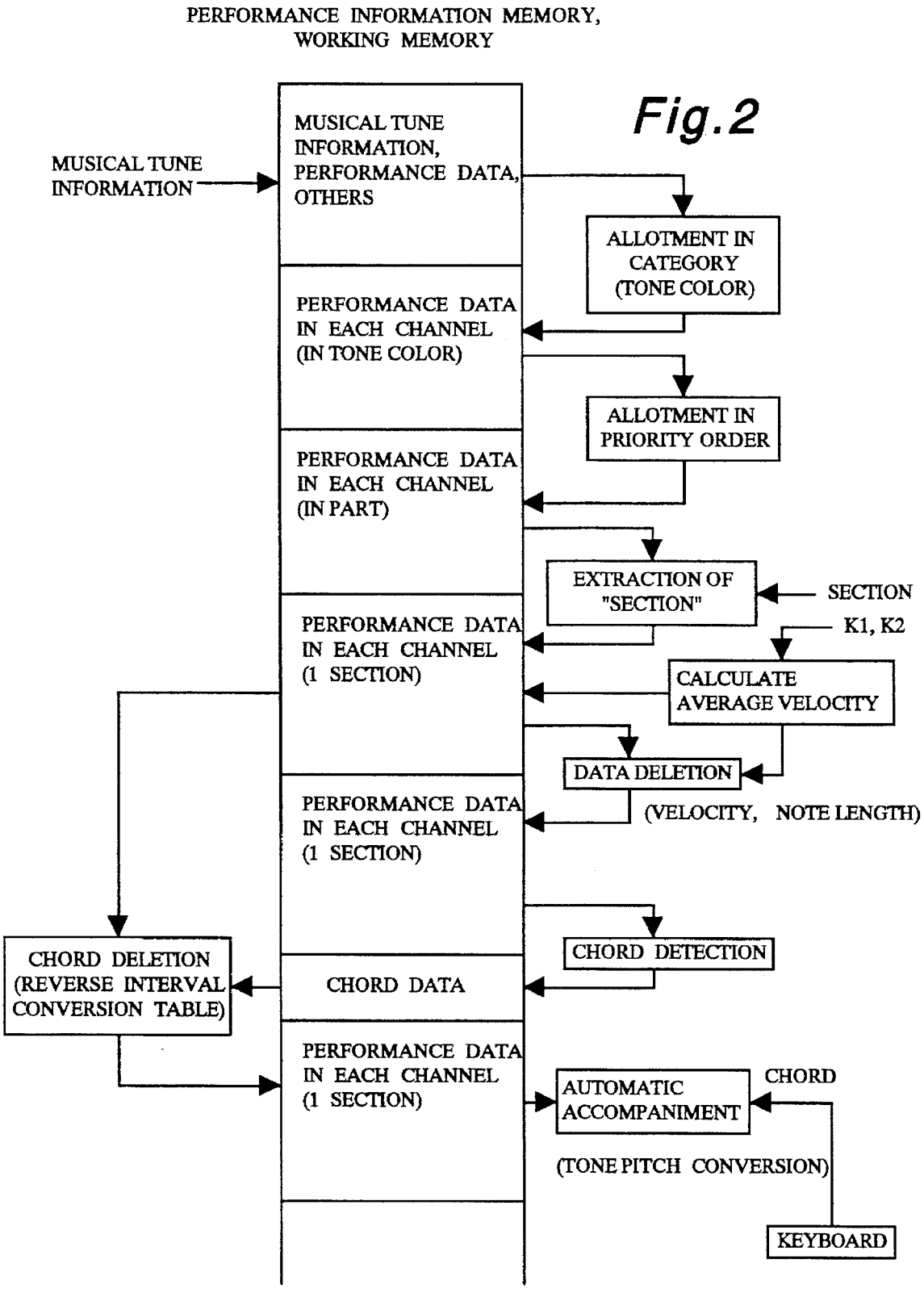
PERFORMANCE INFORMATION MEMORY,
WORKING MEMORY
Fig.2
MUSICAL TUNE INFORMATION
MUSICAL TUNE INFORMATION, PERFORMANCE DATA, OTHERS
ALLOTMENT IN CATEGORY (TONE COLOR)
PERFORMANCE DATA IN EACH CHANNEL (IN TONE COLOR)
ALLOTMENT IN PRIORITY ORDER
PERFORMANCE DATA IN EACH CHANNEL (IN PART)
EXTRACTION OF "SECTION"
SECTION
K1, K2
PERFORMANCE DATA IN EACH CHANNEL (1 SECTION)
CALCULATE AVERAGE VELOCITY
DATA DELETION
(VELOCITY, NOTE LENGTH)
PERFORMANCE DATA IN EACH CHANNEL (1 SECTION)
CHORD DETECTION
CHORD DELETION (REVERSE INTERVAL CONVERSION TABLE)
CHORD DATA
PERFORMANCE DATA IN EACH CHANNEL (1 SECTION)
AUTOMATIC ACCOMPANIMENT
CHORD
(TONE PITCH CONVERSION)
KEYBOARD

REVERSE NOTE-DEGREE CONVERSION TABLE

| NOTE CODE | | 0 | 1 | 2 | 3 | 4 | 5 | 6 | 7 | 8 | 9 | 10 | 11 |
|---|---|---|---|---|---|---|---|---|---|---|---|---|---|
| TONE NAME | | C | C# | D | D# | E | F | F# | G | G# | A | A# | B |
| STYLE | Maj 7 | 0 | 0 | 0 | 0 | 0 | 0 | 0 | 0 | 0 | 0 | 0 | 0 |
| | Maj | -1 | 0 | 0 | 0 | 0 | 0 | 0 | 0 | 0 | 0 | 0 | 0 |
| | min | -1 | 0 | 0 | 1 | 0 | 0 | 0 | 0 | 0 | 0 | 0 | 0 |

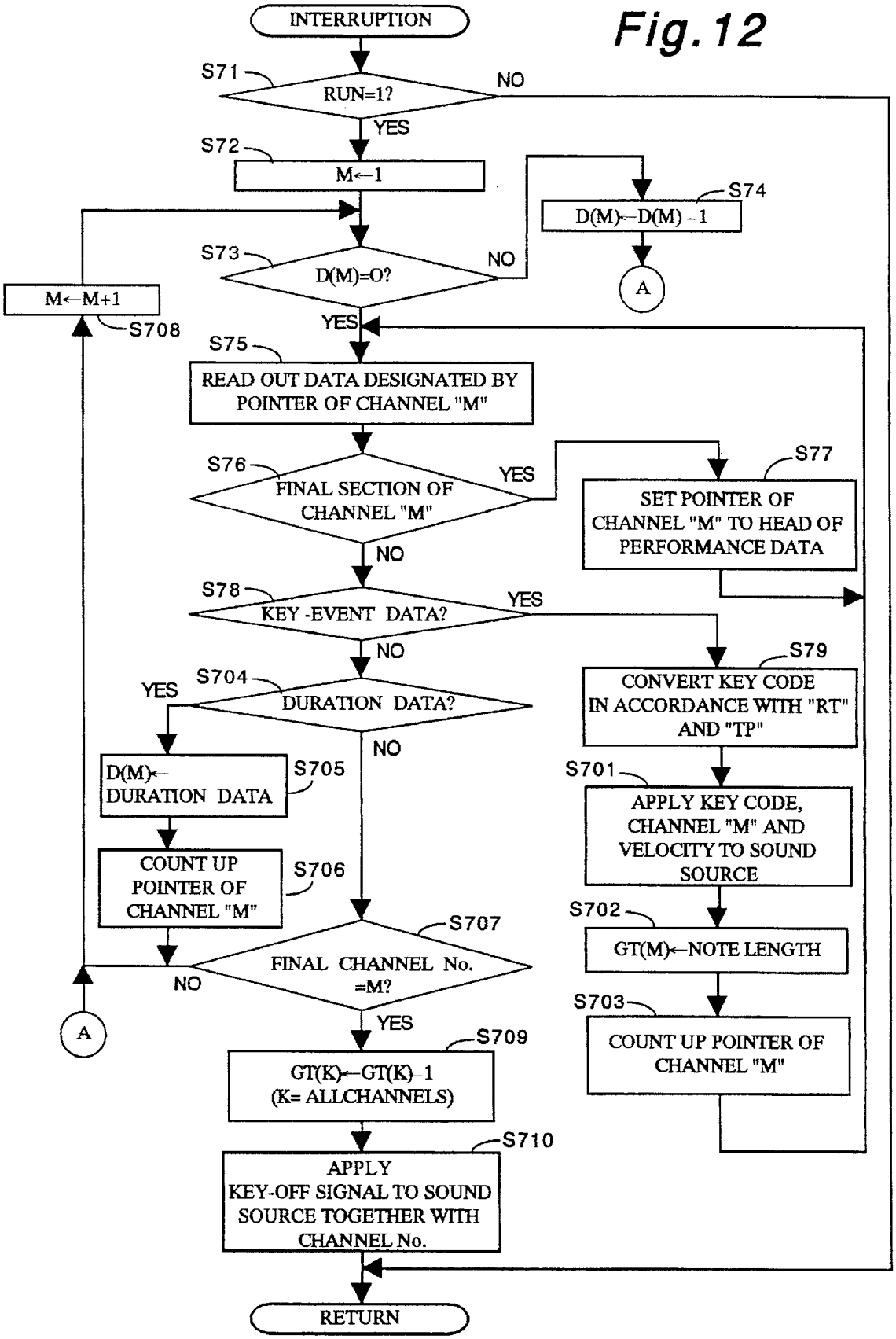
Fig. 12
INTERRUPTION
S71
RUN=1?
NO
YES
S72
M←1
S74
D(M)←D(M) -1
A
S73
D(M)=O?
NO
M←M+1
S708
YES
S75
READ OUT DATA DESIGNATED BY POINTER OF CHANNEL "M"
S76
FINAL SECTION OF CHANNEL "M"
YES
S77
SET POINTER OF CHANNEL "M" TO HEAD OF PERFORMANCE DATA
NO
S78
KEY -EVENT DATA?
YES
NO
S79
CONVERT KEY CODE IN ACCORDANCE WITH "RT" AND "TP"
S704
DURATION DATA?
YES
NO
D(M)← DURATION DATA
S705
S701
APPLY KEY CODE, CHANNEL "M" AND VELOCITY TO SOUND SOURCE
COUNT UP POINTER OF CHANNEL "M"
S706
S702
GT(M)←NOTE LENGTH
S707
FINAL CHANNEL No. =M?
NO
A
YES
S703
COUNT UP POINTER OF CHANNEL "M"
S709
GT(K)←GT(K)-1 (K= ALLCHANNELS)
S710
APPLY KEY-OFF SIGNAL TO SOUND SOURCE TOGETHER WITH CHANNEL No.
RETURN

PERFORMANCE DATA EDITING APPARATUS

BACKGROUND OF THE INVENTION

1. Field of the Invention

The present invention relates to a performance data editing apparatus for editing performance data applied from an external memory element or performance apparatus in such a manner as conversion or modification thereof for production of a desired automatic accompaniment pattern.

2. Description of the Prior Art

In Japanese Patent Laid-open Publication No. 5(1993)-232938 there has been proposed an automatic performance apparatus wherein performance data memorized in a memory are designated at a desired section thereof and repeatedly read out with a chord detected at the left-hand key area of a keyboard to convert a key code of the performance data In tone pitch in accordance with the detected chord for producing a musical tone for automatic accompaniment.

In such a conventional automatic performance apparatus as described above, the performance data of the desired section arc repeatedly read out for reproduction in automatic accompaniment and edited on a basis of performance at the left-hand key area of the keyboard in such a manner as partial insertion, substitution overlap or the like. Since in the conventional apparatus, tone pitch information corresponding with a predetermined standard chord (for instance, C major) is memorized to convert the performance data in tone pitch on a basis of a relationship between the standard chord and the root of the detected chord, the performance data will become unnatural in a musical sense if an accompaniment tone corresponding with the standard tone is not performed. In addition, the edited performance data are determined in dependence upon the key area or tone area of the keyboard. In the conventional apparatus, the chord tone may not be accurately detected if a performance tone is produced by an error In key touch during the keyboard performance for automatic accompaniment. Although in all automatic performance apparatus disclosed in Japanese Patent Laid-open Publication No. 59(1984)-195281, a chord is detected from a key code at a key-on event of strong touch or large velocity for reduction or undesired influence caused by an error in key touch on the keyboard, the chord tone may not be accurately detected when the key touch or the player is different in accordance with a musical tune. As a result, the performance data obtained by edition is restricted in a small range.

SUMMARY OF THE INVENTION

It is, therefore, an object of the present invention to provide a performance data editing apparatus capable of editing performance data applied from an external memory or an appropriate performance apparatus for automatic accompaniment natural in a musical sense and of conducting the edition of the applied performance data such as conversion or modification thereof in a wide range.

Another object of the present invention is to provide a performance data editing apparatus, having the above-mentioned characteristic, capable of accurately detecting a chord of the applied performance data for edition.

According to the present invention, there is provided a performance data editing apparatus which comprises input means to be applied with performance data of a musical tune from an external memory element or performance apparatus, the musical tune including a plurality of performance parts at least one of which represents chords indicative of a musical progression having a performance pattern; means for detecting the chords in the applied performance data; means for normalizing the detected chords of the applied performance data by converting them into a predetermined tone scale on a basis of their respective types and roots; chord designation means for designating chords to be performed for production of a desired accompaniment data: and conversion means for converting the normalized chords on a basis of the designated chords to produce edited chords indicative of a progression of the designated chords in the performance pattern indicated by the applied performance data.

According to all aspect of the present invention, the means for normalizing the detected chords of the applied performance data comprises means for converting the applied performance data into tone pitches of a predetermined tone scale on a basis of the detected chord with reference to a reverse note-degree conversion table.

According to another aspect of the present invention, the means for normalizing the detected chords of the applied performance data comprises means for reversely shifting note data constituting a chord in the applied performance data in such a manner that the root of the chord becomes the root of a predetermined tone scale on a basis of the root of the detected chords of the applied performance data.

According to a further aspect of the present invention, the performance data editing apparatus further comprises means for defining a simultaneous tone degree of the number of tones to be generated at the same time and a note presence degree or ratio of the number of measures including at least one note to the number of all the measures; and allotment means for allotting a bass part of the applied performance data to one of plural channels for a particular tone color in accordance with the simultaneous tone degree and the note presence degree, for allotting a chord part of the applied performance data to a channel the simultaneous tone degree of which is largest in the remaining channels and for allotting a pad part of the applied performance data to a channel the note presence degree of which is largest in the remaining channels.

According to a still another aspect of the present invention, the performance data editing apparatus further comprises means for calculating each average velocity of performed elements and for defining a threshold value for the average velocity and means for deleting note data whose velocity is less than the threshold value during detection of the designated chords.

BRIEF DESCRIPTION OF THE DRAWINGS

Other objects, features and advantages of the present invention will be more readily appreciated from the following detailed description of a preferred embodiment thereof when taken together with the accompanying drawings, in which:

FIG. 2 is a conceptual illustration of performance data processing in a preferred embodiment of the present invention:

FIG. 12 is a flow chart of an interruption routine in the preferred embodiment.

DESCRIPTION OF THE PREFERRED EMBODIMENT

Figure 1:
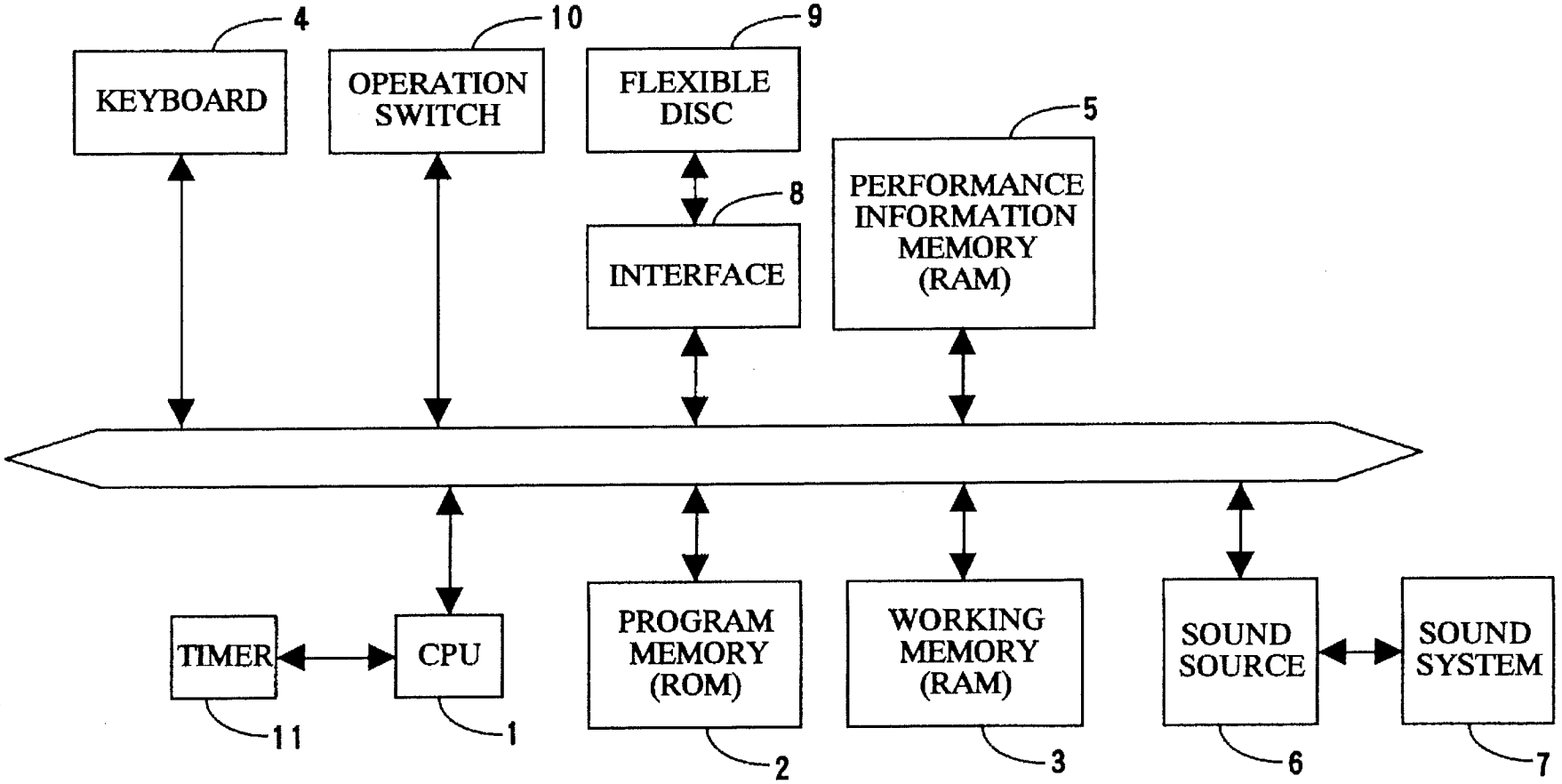
FIG. 1 is a block diagram of an electronic musical instrument provided with a performance data editing apparatus in accordance with the present invention.

In FIG. 1 of the drawings, there is illustrated a block diagram of an electronic musical instrument wherein a central processing unit or CPU 1 cooperates with a working memory 3 to execute a control program stored in a program memory 2 for entire control of the musical instrument and to effect keyboard performance played on a keyboard 4 and automatic accompaniment on a basis of performance data memorized in a performance information memory 5. A sound source 6 of the musical instrument is constructed to produce a musical tone signal at plural channels by time divisional multiple processing. In the sound source 6, each tone color at the channels is determined by the CPU 1. When applied with a key code and a key-on signal, the sound source 6 produces a musical tone signal at a channel designated by the CPU 1 and applies the musical tone signal to a sound system 7.

The CPU 1 detects a key-event on the keyboard 4 to read out a key-on or key-off signal with a key code at the key-event and applies the key code and key-on or key-off signal to the sound source 6 for sound processing or mute processing of the keyboard performance. The CPU 1 reads out a musical tune information from a flexible disc 9 through an interface 8 and stores it in the performance information memory 5 for edit processing of performance data of the musical tune at an edit mode describes later. At an automatic accompaniment mode, the CPU 1 converts the stored performance data in tone pitch on a basis of a chord applied from the keyboard 4 and applies the key code of the converted performance data with the key-on or key-off signal to the sound source 6 for automatic accompaniment.

In response to operation of a group of operation switches 10, the CPU 1 further executes input processing of the musical tune, processing for tone color selection at the keyboard 4, input processing of a tempo of automatic accompaniment, selection processing of the edit mode and start or stop processing of the automatic accompaniment, etc. When applied with the tempo of the automatic accompaniment under control of the CPU 1, a timer 11 produces ninety six (96) tempo clock signals per one measure. Thus, the CPU 1 executes interruption processing in response to the tempo clock signals to effect the automatic accompaniment.

In this embodiment, the edit processing of the performance data is executed by the CPU 1 as illustrated in FIG. 2. Assuming that a musical tune has been memorized in the performance information memory 5 from the flexible disc 9 under control of the CPU 1, performance data of the musical tune are memorized in the performance memory 5 as shown by a format in FIG. 3. In this instance, the performance data includes note data corresponding with the score of the musical tune, and the note data of one tone is in the form of a set of tone color data 1, 2, 3, . . . indicative of a tone color and a key-event data. The key-event data is comprised of a key code, a velocity and a note length. An interval of each key-event data is designated by a duration data.

Figure 3:
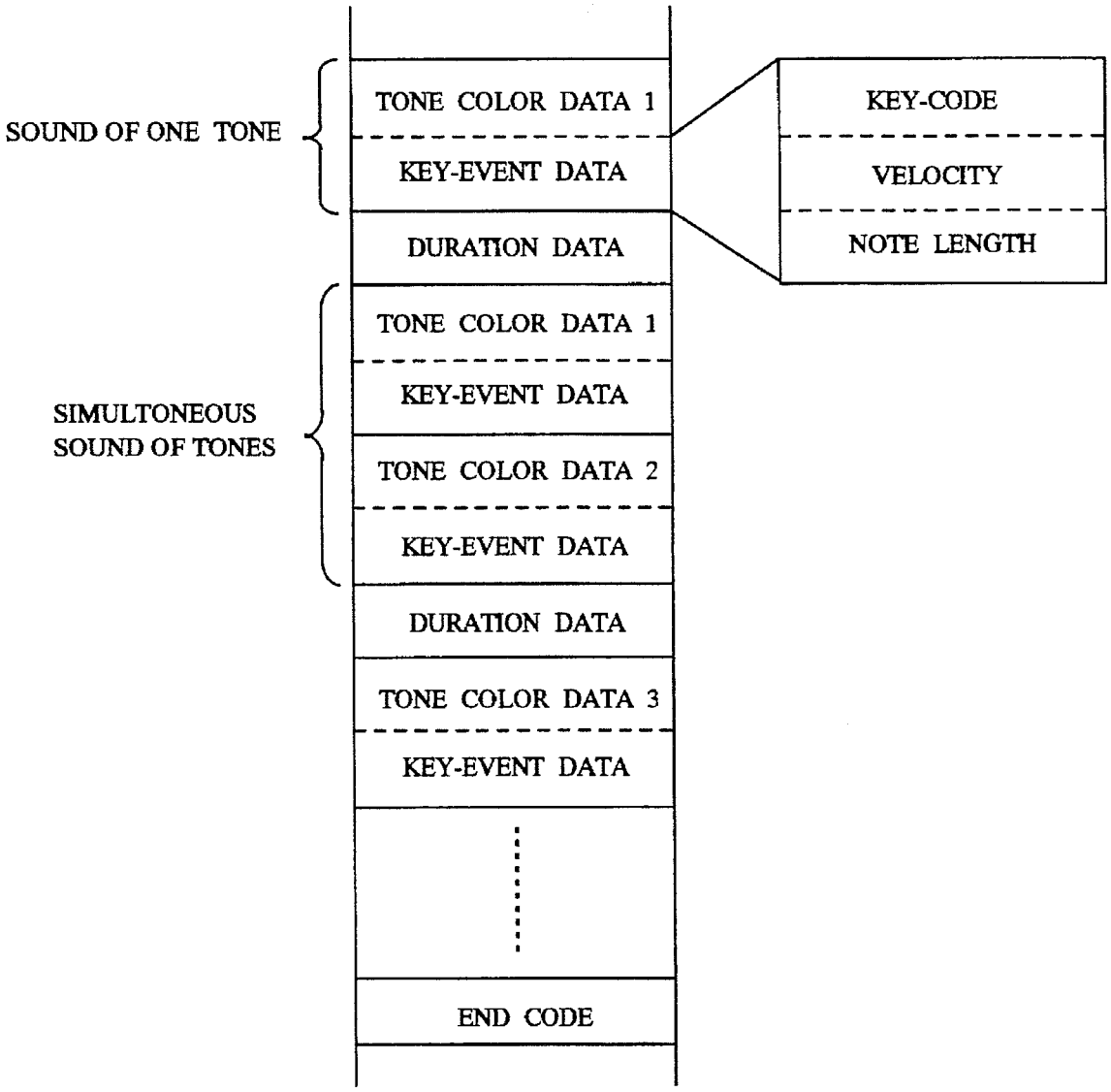
FIG. 3 is a format of performance data supplied in the preferred embodiment.
Figures 4, 5:
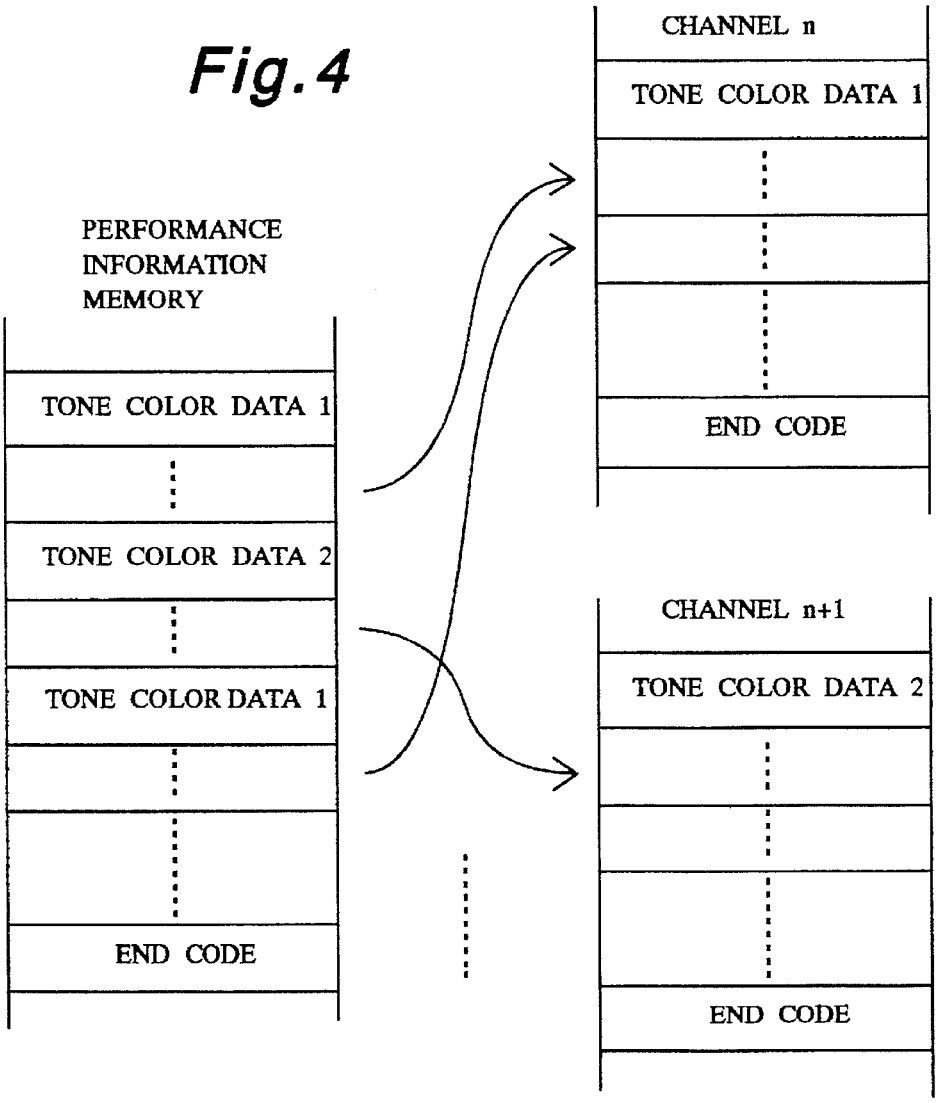
FIG. 4 is an illustration of allotment of tone color data in category.
FIG. 5 depicts an example of a reverse note-degree conversion table in the preferred embodiment.

For instance, in the case of generation of one tone and simultaneous generation of two tones as shown in FIG. 3, the duration data indicative of the interval of each key-event data is recorded only between note data of tones to be generated at a different time without being recorded between the note data of tones to be generated at the same time. At an edit mode of the performance data, allotment in category for allotting the same tone color data to the identical channel is made as shown in FIG. 4. In this instance, the duration data is converted from an original duration and recorded in each of the channels so that the performance data can be reproduced at the same timing as the original performance data even when independently reproduced at each of the channels.

(Allotment in Priority Order)

Subsequently, the CPU 1 executes processing for allotting each part of the performance data to the channels in a priority order. In this processing, the CPU 1 calculates a total length "T" of all the notes and a total "t" of times of tones being generated at the respective channels to define a radio of T/t as a degree PR (hereinafter simply called a simultaneous tone degree) of the number of tones to be generated at the same time. The CPU 1 further defines a ratio (hereinafter simply called a note presence degree) of the number of measures including at least one note to the number of all The measures. Thus, the CPU 1 allots a bass part of the performance information to the channel for a particular tone color such as bass, woody bass or the like, a chord part "1" of the performance information to a channel the simultaneous tone degree PR of which is largest in the remaining channels, a pad part of the performance information such as a continual tone of strings to a channel the note presence degree ER of which is largest in the remaining channels, and a chord part "2" of the performance information to a channel the simultaneous tone degree PR of which is largest in the remaining channels.

(Extraction of Sections)

Assuming that the group of switches 10 has been operated by the player at the edit mode to designate a desired section of the performance data, the performance data of the designated section is extracted from the channels allotted to the parts thereof, and the duration data is supplemented and memorized in the performance information memory 5 without causing any relative change of the reproduction timing of the channels.

(Data Deletion).

With respect to the performance data allotted in category and priority order and extracted in such a manner as described above, the CPU 1 calculates an average velocity at the respective channels. The calculated average velocity is weighted with a weight coefficient K1 (1>K1) and defined as a threshold value of the average velocity. Thus, the CPU 1 deletes unnecessary data less than the threshold value of the average velocity and deletes data less than a reference note length K2 (for instance, 16th note or 32nd note) defined as a threshold value. That is to say, unwanted data caused by an error in key touch on the keyboard is deleted since the velocity of the unwanted data is less than the average velocity, and an extremely short data of note length is also deleted since such data is other than a chord constituent tone such as approach notes. After deletion and extraction of unnecessary data, the CPU 1 detects a chord tone based on the parts allotted in the priority order and memorizes the duration data together with the root and type of the detected chord tone and a bass tone (a tone name).

(Chord Deletion)

The performance data is further converted into a tone pitch of C Maj7 on a basis of the detected chord information with reference to a reverse note-degree conversion table and memorized in the performance information memory 5. Illustrated in FIG. 5 is an example of the reverse note-degree conversion table. Assuming that the note data of the performance data is "A#" and that the detected chord is "Gm", the root of the chord is "G". Thus, the note code of "G" is subtracted from the note code of "A#" to reversely shift "A#" to "D#". Since the type of the detected chord is a minor key, a reverse conversion data "1" is read out from "D#" and "min" in the reverse note-degree conversion table of FIG. 5 and added to the note code of "D#" for reverse conversion to "E". Thus, the note data "A#" of the constituent tone (Minor 3rd note) of the chord "Gm" is converted into "E" of a tone (Major 3rd note) corresponding with the constituent tone of the chord C Maj7.

That is to say, the note data (key code) of the performance data is reversely shifted in such a manner that the root of the note data becomes "C" on a basis of the root of the detected chord. The reversely shifted note data is converted into a tone pitch corresponding with the chord of C Maj7 on a basis of the type of the detected chord and memorized in the performance information memory 5.

After the chord detection and edition of the tone pitch conversion described above, automatic accompaniment is effected on a basis of the edited performance data at the automatic accompaniment mode as follows. At the automatic accompaniment mode, the CPU 1 repeatedly reads out the key-event data and duration data in the designated section at the respective channels of the performance data after edition of tho performance information memory 5 to convert the key code of the key-event data in tone pitch on a basis of the detected chord and to apply the converted key code to the sound source 6 for effecting the automatic accompaniment.

Figure 6:
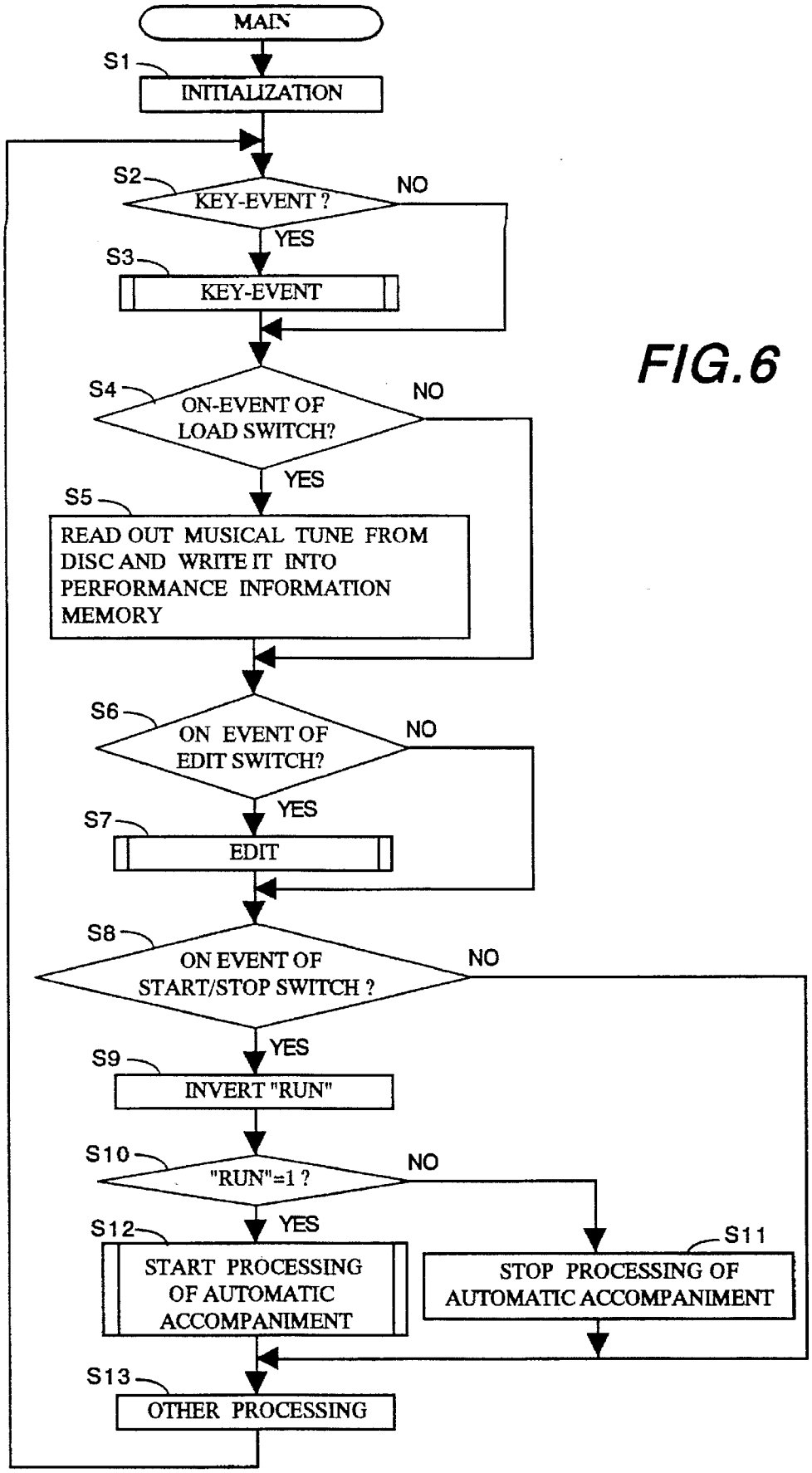
FIG. 6 is a flow chart of a main routine of a control program executed by a central processing unit or CPU shown in FIG. 1.

Hereinafter, operation of the electronic musical instrument will be described with reference to a flow chart of a main routine of a control program shown in FIG. 6, subroutines shown in FIGS. 7 to 11 and an interruption routine shown in FIG. 12. In the following description, respective registers and flags used in control of the electronic musical instrument are represented as listed below.

RT: Register for storing the root of a chord applied from the keyboard

TP: Register for storing the type of the chord applied from the keyboard

VL: Register for storing a calculated average velocity

VLK: Register for storing a threshold value of velocity

K1: Register for storing a weight coefficient of the average velocity

K2; Register for storing a reference note length applied as a threshold of data deletion ND: Register for storing a value of K2

I: Register adapted as a counter for counting a designated section at ½ beat

N: Register for administration of a channel number at an edit mode

RUN: Flag indicative of start/stop of automatic accompaniment

M, K: Register for administration of the channel number at an automatic accompaniment mode D(M): Register for storing a duration time of a channel M GT(M): Register for storing a note length of the channel M Assuming that the electronic musical instrument has been connected to an electric power source, the CPU 1 is activated to execute the main routine of the control program shown in FIG. 6. At step S1, the CPU 1 initializes the foregoing registers and causes the program to proceed to step S2. At step S2, the CPU 1 determines whether a key-event on the keyboard 4 is present or not. If the answer at step S2 is "No", the program proceeds to step S4. If the answer at step S2 is "Yes", the CPU 1 executes at step S3 processing of a key-event routine shown in FIG. 7 and causes the program to proceeds to step S4.

At step S4, the CPU 1 determines whether an on-event of a load switch of the switch group 10 is present or not. If the answer at step S4 is "No", the program proceeds to step S6. If the answer at step S4 is "Yes", the CPU 1 reads out at step S5 performance data of a musical tune from a flexible disc 9 and writes the performance data of the musical tune into the performance information memory 5. When the program proceeds to step S6, the CPU 1 determines whether an on-event of an edit switch of the switch group 10 is present or not. If the answer at step S6 is "No", the program proceeds to step S8. If the answer at step S6 is "Yes", the CPU 1 executes at step S7 processing of an edit routine shown in FIG. 8 and causes the pro.ram to proceed to step S8. At step S8, the CPU 1 determines whether an on-event of a star/stop switch of the switch group 10 is present or not. If the answer at step S8 is "No", the program proceeds to step S13. If the answer at step S8 is "Yes", the CPU 1 inverts the flag RUN at step S9 and determines at step S10 whether the flag RUN is "1" or not if the answer at step S10 is "No", the program proceeds to step S11 where the CPU 1 executes processing for stop of the automatic accompaniment and causes the program to proceed to step S13. If the answer at step S10 is "Yes", the CPU 1 executes at step S12 processing of a start routine for the automatic accompaniment shown in FIG. 11 and returns the program to step S2 after execution of other processing for selection of a tone color or the like at step S13.

Figure 7:
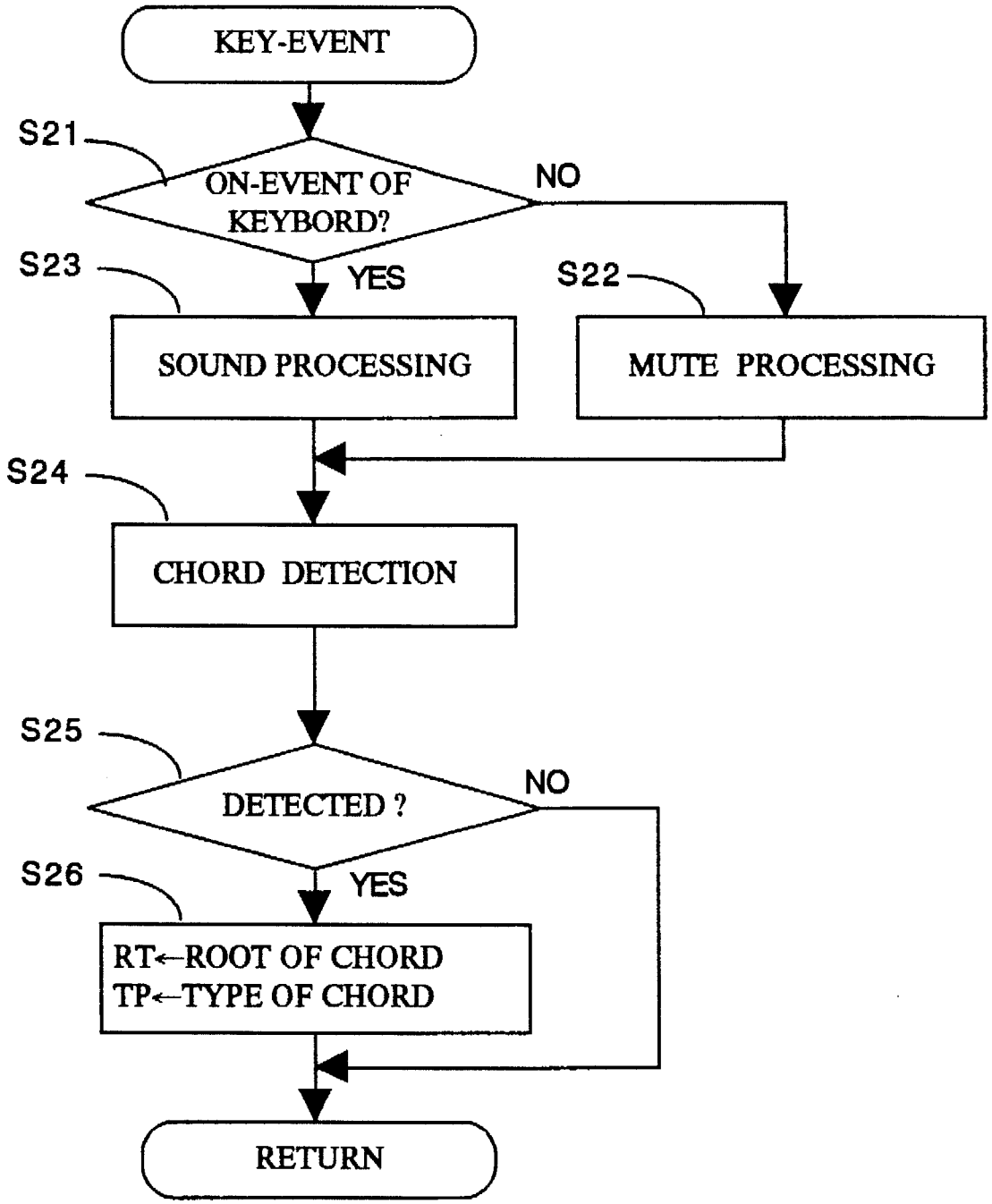
FIG. 7 a flow chart of a key-event routine shown in FIG. 6.

During processing of the key-event routine shown in FIG. 7, the CPU 1 determines at step S21 whether the key-event is a key-on event or not. If the answer at step S21 is "No", the CPU 1 executes mute processing at step S22 and causes the program to proceed to step S24. If the answer at step S21 is "Yes", the CPU 1 executes sound processing at step S23 and causes the program to proceed to step S24. At step S24, the CPU 1 detects a chord based on the key code of the key-event and determines at step S25 whether the chord has been detected or not. If the answer at step S25 is "No", the program returns to the main routine. If the answer at step 25 is "Yes", the CPU 1 stores the root and type of the detected chord respectively in the registers RT and TP and returns the program to the main routine. With such processing of the key-event routine described above, the sound or mute of the keyboard performance is effected, and a designation chord for automatic accompaniment is detected from the keyboard 4. Thus, the root and type of the designation chord are stored in the registers RT and TP respectively.

Figure 8:
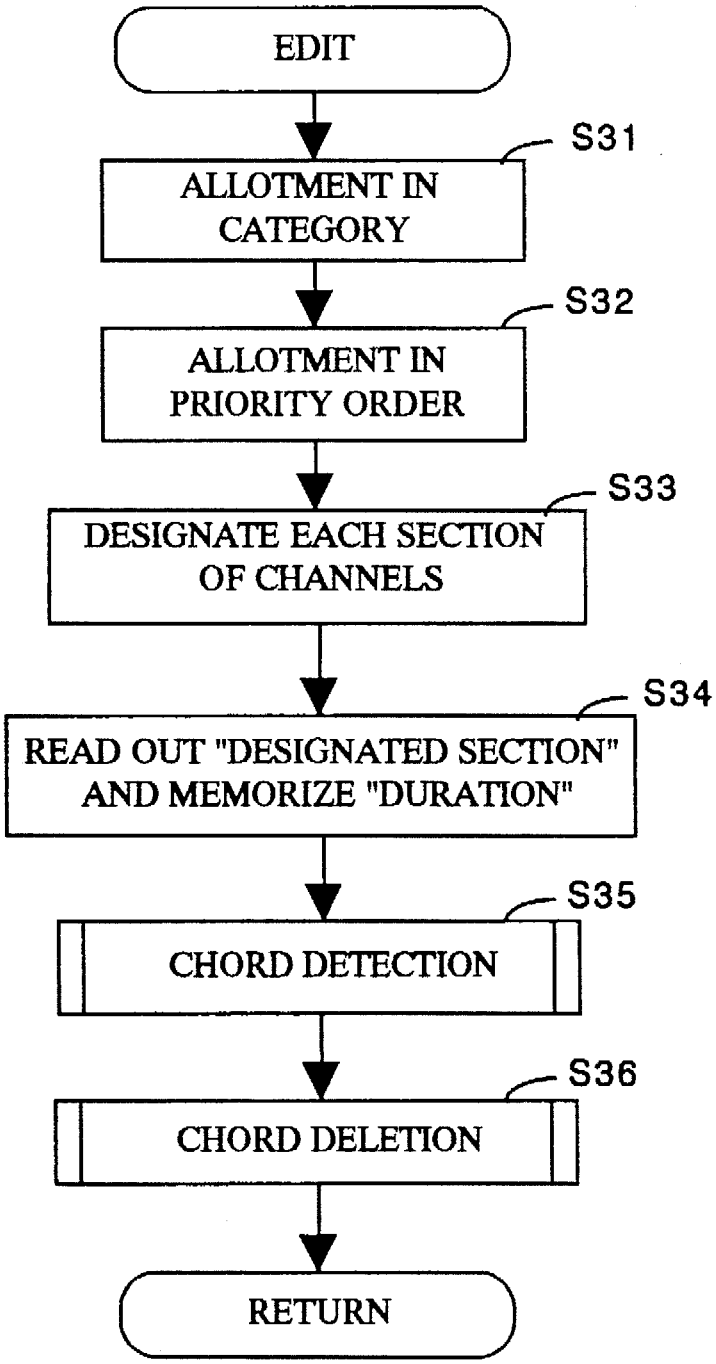
FIG. 8 is a flow chart of an edit routine shown in FIG. 6.

During processing of the edit routine shown in FIG. 8, the CPU 1 executes at step S31 processing for allotment in category to allot each track to the channels in accordance with a tone color and causes the program to proceed to step S32. At step S32, the CPU 1 executes processing for allotment in the order of priority to allot preferentially selected channels to each part of the performance information in accordance with the simultaneous tone degree PR or the note presence degree ER and causes the program to proceed to step S33. At step S33, the CPU 1 executes input processing of each section (for instance, from a 17th measure to a 20th measure) of the performance information data designated by the player in accordance with operation of the switch group 10 and causes the program to proceed step S34. At step S34, the CPU 1 extracts each performance data from the designated sections and supplements a duration data without causing any relative change of reproduction timing of the channels. Thus, the CPU 1 memorizes each performance data of the channels relatively arranged in reproduction timing into the performance information memory 5. Subsequently, the CPU 1 executes at step S35 processing of a chord detection routine shown in FIG. 9 and executes at step S36 a chord deletion routine shown in FIG. 10. Thereafter, the CPU 1 returns the program to the main routine.

With processing of the edit routine described above, the performance data are first allotted to the channels in accordance with the tone color, and the channels are alloted to the preferentially selected parts respectively on a basis of each specific tone color of a bass, a woody bass, etc., the simultaneous tone degree PR and the note presence degree ER. Thus, each performance data designated at the channels is extracted and memorized in the performance information memory 5 as each performance data of the channels relatively arranged in reproduction timing, and processing of the chord detection routine and chord deletion routine is executed.

Figure 9:
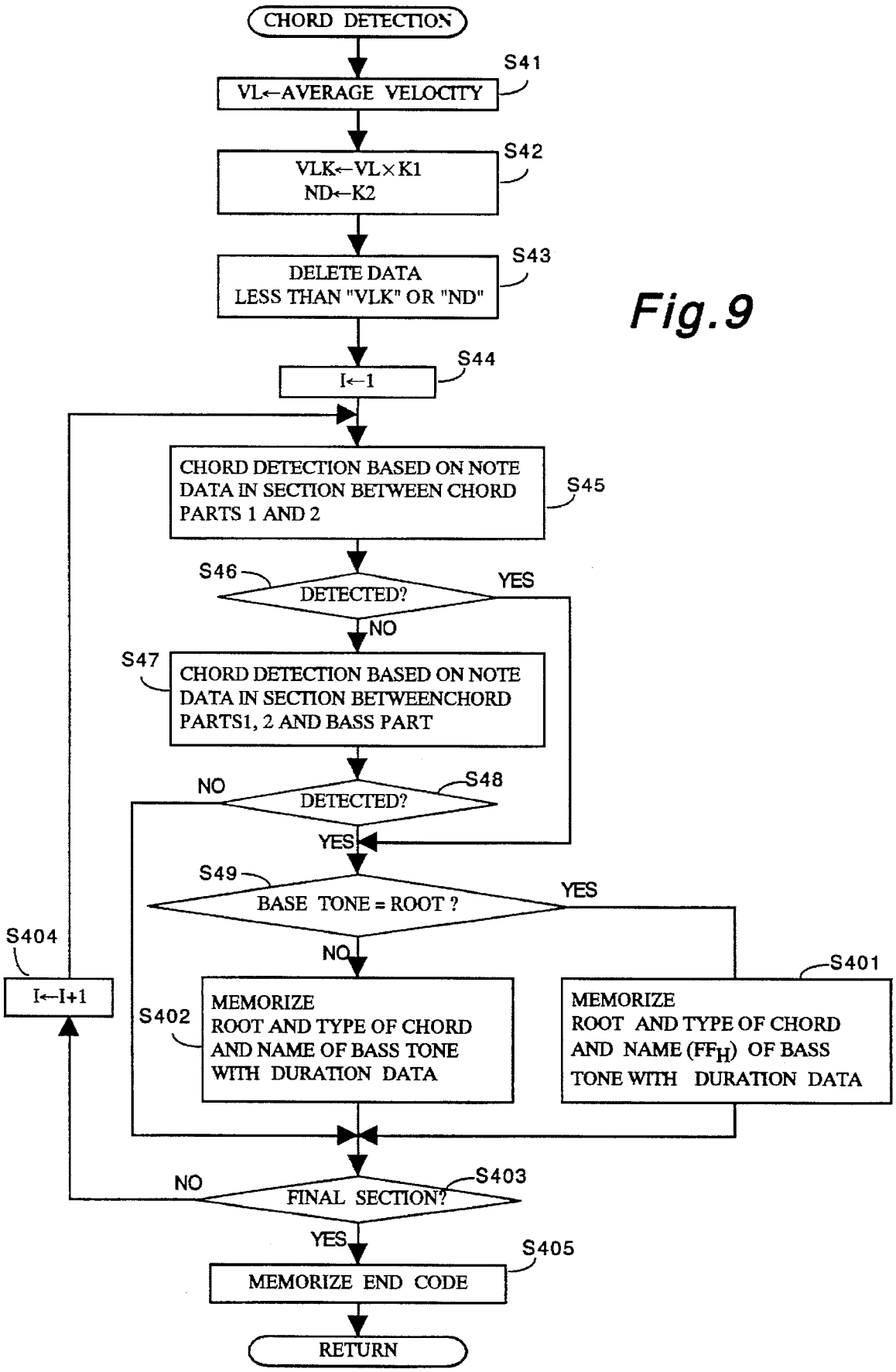
FIG. 9 is a flow chart of a chord detection routine shown in FIG. 8.

During processing of the chord detection routine shown in FIG. 9, the CPU 1 calculates as step S41 an average velocity from velocity data of note data in the section of each channel and memorizes the calculated average velocity in the register VL. Subsequently, the CPU 1 multiplies at step S42 the average velocity by a weight coefficient K1 and memorizes a resultant of the multiplication in the register VLK as a threshold value of the average velocity. In this instance, the CPU 1 further memorizes a reference note length K2 applied thereto in the register ND as a threshold value of note length. At the following step S43, the CPU 1 deletes a velocity data less than the threshold value VLK or a note length data less than the reference note length ND. In this embodiment, the weight coefficient K1 is determined to be about 0.5 in consideration with a lower velocity than the average velocity. Thus, a note data caused by an error in key touch on the keyboard is deleted. The reference note length K2 is determined to be a short note length such as a sixteenth note or a thirty second note. Thus, unwanted approach notes are deleted to enhance accuracy of the chord detection.

Subsequently, the CPU 1 sets at step S44 the register I for counting a designated section at ½ beat as "1" and detects at step S45 a chord based on a note data in a section I between chord parts 1 and 2. Thus, the CPU 1 determines at step S46 whether the chord has been detected or not. If the answer at step S46 is "Yes", the program proceeds to step S49. If the answer at step S46 is "No", the program proceeds to step S47 where the CPU 1 detects a chord based on a note data in a section I between the chord parts 1, 2 and a bass part. Thus, the CPU 1 determines at step S48 whether the chord has been detected or not. If the answer at step S48 is "Yes", the program proceeds to step S49. If the answer at step S48 is "No", the program proceeds to step S403. At step S49, the CPU 1 determines whether the root of the detected chord is equal to a bass tone of the bass part or not. If the answer at step S49 is "Yes", the CPU 1 memorizes at step 401 the root and type of the detected chord and the name of the bass tone with the duration data in the performance information memory 5 as a deform value "$FF^{H}$" and causes the program to proceed to step S403. If the answer at step S49 is "No", the CPU 1 memorizes at step S402 the root and type of the detected chord and the name of the bass tone with the duration data in the performance information memory 5 and causes the program to proceed to step 403. In such art instance, the chord at step S401 is memorized as an ordinary chord without any bass tone, and the chord at step 402 is memorized as a chord designated with the bass tone. At step S403, the CPU 1 determines whether a final section I of the performance information has been designated or not. If the answer at step S403 is "No", the program proceeds to step S404 where the CPU 1 renews the register I by increment of "1" for repeatedly executing the processing at step S45 to S402. If the answer at step S403 is "Yes", the CPU 1 memorizes an end code at step S405 and returns the program to the main routine.

With the processing of the chord detection routine, unwanted note data caused by an error in key touch on the keyboard is deleted in comparison with the average velocity VLK of the note data and the reference note length ND, and the chord is detected in accordance with the respective parts in each designated section at ½ beat. Thus, the detected chord and duration data are memorized in the performance information memory 5.

Figure 10:
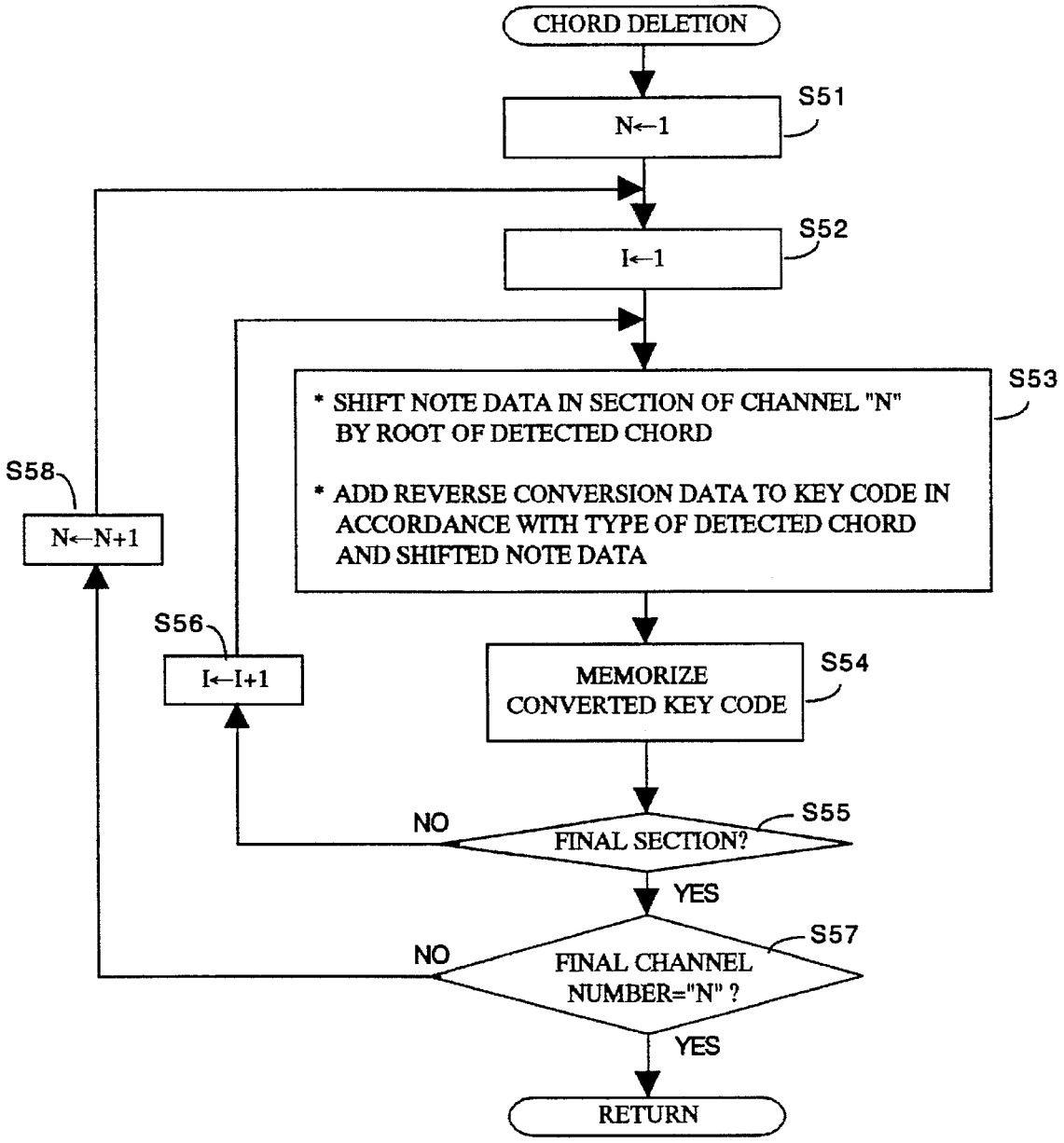
FIG. 10 is a flow chart of a chord deletion routine shown in FIG. 8.

During processing of the chord deletion routine shown in FIG. 10, the CPU 1 sets at step S51 the register N for administration of the channel number as "1" and sets at step S52 the register I for counting each section at ½ beat as "1". At the following step 353, the CPU 1 reversely shifts the note data in the section of the channel number N by the root of the detected chord. In addition, as previously described with reference to FIG, 5, the CPU reads out a reverse conversion data from the reverse note-degree conversion table in accordance with the type of the detected chord and the key code of the reversely shifted note data and adds the reverse conversion data to the key code. Subsequently, the CPU 1 memorizes at step S54 the converted key code in the performance information memory 5 as edited performance data and determines at step S55 whether a final section of the channel number N has been processed or not. If the answer at step S55 is "No", the program proceeds to step S56 where the CPU 1 renews the register I by increment of "1" and returns the program to step S53 for repeatedly executing the processing at step S53 and S54. When the CPU 1 determines a "Yes" answer at step S55, the program proceeds to step S57 where the CPU 1 determines whether a final channel has been processed or not. If the answer at step S57 is "No", the program proceeds to step S58 where the CPU 1 renews the channel number N by increment of "1" and returns the program to step S52 for processing of the following channel at step S52 to S56. When determined a "Yes" answer at step S57, the CPU 1 returns the program to the main routine.

With the processing of the chord deletion routine, the key code of the note data is modified to a tone pitch corresponding with a chord of C Maj7 on a basis of the chord detected at ½ beat in each section designated at each of the channels and memorized in the performance information memory 5 as edited performance data.

Figure 11:
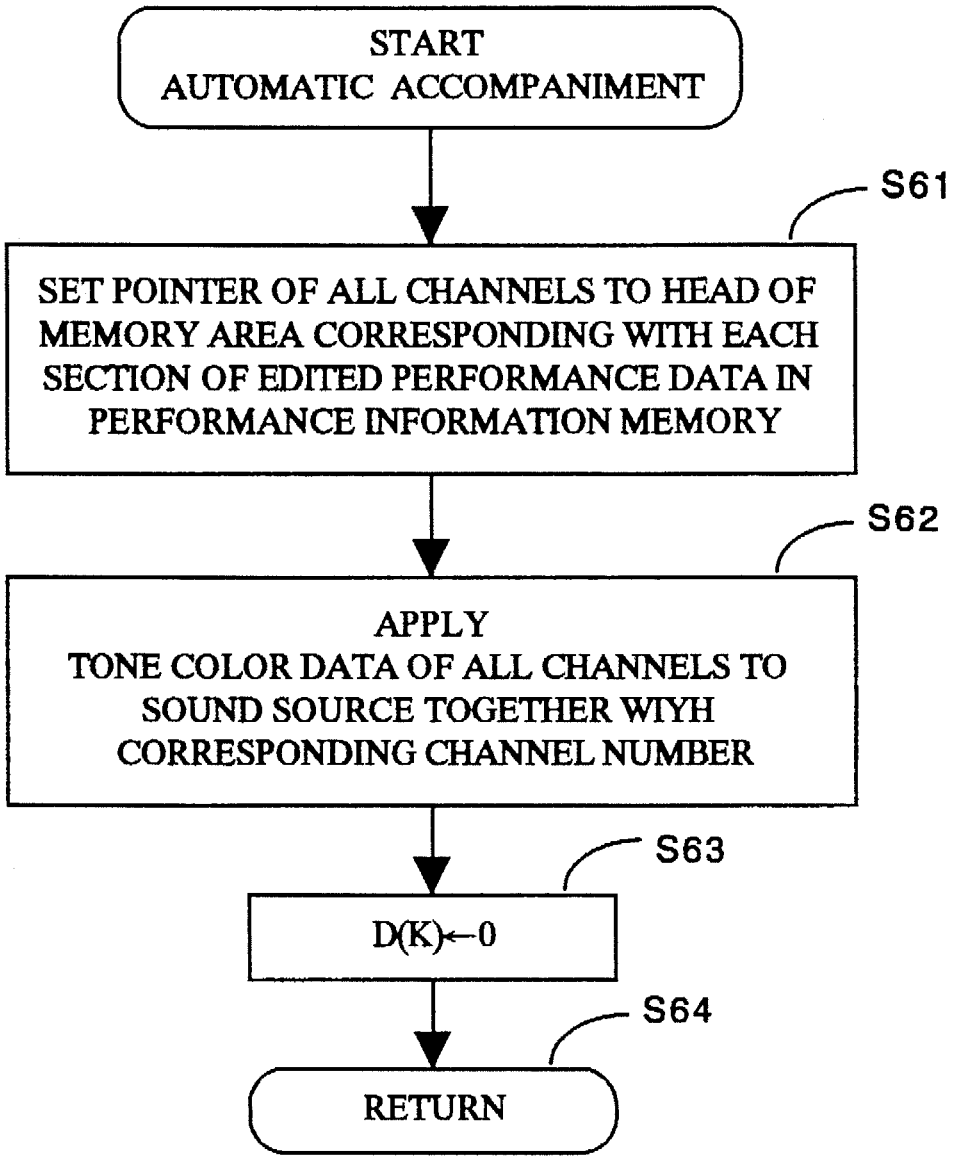
FIG. 11 is a flow chart of a start routine for automatic accompaniment.

During processing of the start routine for automatic accompaniment shown in FIG. 11, the CPU 1 sets at step S61 each reading pointer of all the channels to a head of a memory area corresponding with each section of the edited performance data memorized in the performance information memory 5, reads out at step S62 each tone color data of all the channels and applies the tone color data to the sound source 6 together with the corresponding channel number. At the following step S63, the CPU 1 sets each arrangement register D(K)of all the channels for storing each duration data in the channels as "0" and returns the program to the main routine.

During processing of the interruption routine shown in FIG. 12, the CPU 1 is applied with a tempo clock signal from the timer 11 to determine at step S71 whether the flag RUN is "1" or not. If the answer at step S71 is "No", the program returns to the main routine. If the answer at step S71 is "Yes", the CPU 1 sets at step S72 the register M for administration of the channel number as "1" and repeats processing at step S73 to S706 for each channel on a basis of increment of "1" to the register M and determination at step S707. At step S73, the CPU 1 determines whether the register D(M) for counting a duration of the channel M is "0" or not. If the answer at step S73 is "No", the program proceeds to step S74 where the CPU 1 subtracts "1" from the register D(M) and causes the program to proceed to step S708. If the answer at step S73 is "Yes", the CPU 1 reads out at step S75 performance data designated by the reading pointer of the channel M and determines at step S76 whether a final section of the channel M has been processed or not. If the answer at step S76 is "Yes", the CPU 1 sets at step S77 the reading pointer of the channel M to a head of performance data corresponding with start of the following section and returns the program to step S75. If the answer at step S76 is "No", the CPU 1 determines at step S78 whether the read out data is a key-event data or not. If the answer at step S78 is "Yes", the CPU 1 executes sound processing at step S79 to S703.

At step 79, the CPU 1 converts a key code of the key-event data in tone pitch on a basis of the root RT and type TP of the chord detected at the keyboard 4 and causes the program to proceed to step S701. At step S701, the CPU 1 applies the converted key code, the channel number M and the velocity to the sound source 6. Subsequently, the CPU 1 memorizes at step 3702 the note length of the key-event data in the register GT(M) of the channel M, counts up at step S703 the reading pointer of the channel M and returns the program to step S75. If the answer at step S78 is "No", the program proceeds to step S704 where the CPU 1 determines whether the read out data is a duration data or not. If the answer at step S704 is "Yes", the CFU 1 memorizes at step S705 the duration data in the register D(M) of the channel M, counts up at step S706 the reading pointer of the channel M and causes the program to proceed to step S708. If the answer at step S704 is "No", the CPU 1 determines at step S707 whether the current channel number M is a final channel number or not. If the answer at step S707 is "No", the program proceeds to step S708. If the answer at step S707 is "Yes", the program proceeds to step S709 where the CPU 1 subtracts "1" from the note length of all the channels in the register GT(K) and causes the program to proceed to step S710. At step S710, the CPU 1 applies a key-off signal to the sound source 6 together with the channel number of the note length GT(K)=0 and returns the program to the main routine.

With the processing of the interruption routine, the key code of the read out key-event data is converted in tone pitch on a basis of the root RT and type TP of the chord detected at the keyboard 4 while the flag RUN is being maintained as "1", and the respective channels are sounded substantially at the same time. In addition, each timing of the mute processing and the sound processing is defined in accordance with the read out note length and the duration data, and the automatic accompaniment is effected in synchronization with the tempo clock front the timer 11.

As described above, a chord is preliminary detected from the performance data memorized in the performance information memory so that the performance data is converted into tone pitch information corresponding with the normalized standard chord such as C Maj7 in accordance with the detected chord tone. Thus, even if the supplied performance data is not a tone pitch data corresponding with the normalized standard chord, the performance data does not become unnatural in a musical sense. In addition, the supplied performance data is analyzed in accordance with a tone color, and each part of the performance data is allotted to the respective channels in accordance with the tone color, the simultaneous tone degree PR and the note presence degree ER. Thus, the performance data can be edited in a wide range.

Since a note data caused by an error in key touch on the keyboard is deleted from the supplied performance data in comparison with the average velocity VLK, the chord can be accurately detected. In addition, a note data less than the reference note length ND is also deleted from the supplied performance data. This is also useful to enhance accuracy of the chord detection. Thus, even if the performance data are converted or modified into an accompaniment pattern, the automatic accompaniment becomes natural in a musical sense.

Although in the above embodiment, the performance data have been supplied from the flexible disc, the performance data may be supplied by the keyboard performance. Although in the above embodiment, the supplied performance data have been converted in tone pitch on a basis of the detected chord thereof so that the performance data correspond with the normalized standard chord, a key code of performance data read out during automatic accompaniment may be converted in tone pitch on a real time with reference to a note conversion table on a basis of the chord information of the original performance data and the chord information designated at the keyboard.

What is claimed:

1. A performance data editing apparatus comprising:

input means to be applied with performance data of a musical tune from an external memory element or performance apparatus, said musical tune including a plurality of performance parts at least one of which represents chords indicative of a musical progression having a performance pattern;

means for detecting said chords in the applied performance data;

means for normalizing the detected chords of the applied performance data by converting them into a predetermined tone scale on a basis of their respective types and roots:

chord designation means for designating chords to be performed for production of a desired accompaniment data; and conversion means for converting the normalized chords on a basis of the designated chords to produce edited chords indicative of a progression of the designated chords in the performance pattern indicated by the applied performance data.

2. A performance data editing apparatus as recited in claim 1, wherein said means for normalizing the detected chords of the applied performance data comprises means for converting the applied performance data into tone pitches of a predetermined tone scale on a basis of the detected chords with reference to a reverse note-degree conversion table.

3. A performance data editing apparatus as recited in claim 1, wherein said means for normalizing the detected chords of the applied performance data comprises means for reversely shifting note data constituting a chord in the applied performance data in such a manner that the root of the chord becomes the root of a predetermined tone scale on a basis of the root of the detected chords in the applied performance data.

4. A performance data editing apparatus as recited in claim 3, further comprising means for defining a simultaneous tone degree of the number of tones to be generated at the same time and a note presence degree or ratio of the number of measures including at least one note to the number of all the measures: and allotment means for allotting a bass part of the applied performance data to one of plural channels for a particular tone color in accordance with the simultaneous tone degree and the note presence degree.

5. A performance data editing apparatus as recited in claim 4, further comprising allotment means for allotting a chord part of the applied performance data to a channel the simultaneous tone degree of which is largest among those in all the channels.

6. A performance data editing apparatus as recited in claim 5, further comprising allotment means for allotting a pad part of the applied performance data to a channel the note presence degree of which is largest among those in all the channels.

7. A performance data editing apparatus as recited in claim 1, further comprising means for calculating each average velocity of performed elements and for defining a threshold value for the average velocity and means for deleting note data of the performed elements whose velocity is less than the threshold value during detection of the designated chords.

8. A performance data editing apparatus as recited in claim 1, further comprising means for detecting each note length of the applied performance data and for deleting the detected note data whose note length is less than a predetermined reference note length during detection of the designated chords.

* * * * *